US006776647B1

(12) United States Patent
Herrmann et al.

(10) Patent No.: US 6,776,647 B1
(45) Date of Patent: Aug. 17, 2004

(54) INSULATION DISPLACEMENT CONTACT AND CONNECTOR

(75) Inventors: Johann Herrmann, Mallersdorf-Pfaffenberg (DE); Günther Weissberger, Kelheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/030,302

(22) PCT Filed: Apr. 28, 2000

(86) PCT No.: PCT/DE00/01343

§ 371 (c)(1),
(2), (4) Date: Nov. 9, 2001

(87) PCT Pub. No.: WO00/69024

PCT Pub. Date: Nov. 16, 2000

(30) Foreign Application Priority Data

May 11, 1999 (DE) ..... 199 21 769

(51) Int. Cl.[7] ..... H01R 11/20

(52) U.S. Cl. ..... 439/403; 439/875; 439/883; 439/888

(58) Field of Search ..... 439/395–406, 439/875–876, 883–884, 888

(56) References Cited

U.S. PATENT DOCUMENTS

| | | | | | |
|---|---|---|---|---|---|
| 4,813,884 | A | * | 3/1989 | Brubaker | 439/389 |
| 5,282,758 | A | * | 2/1994 | Onoue | 439/395 |
| 6,027,361 | A | * | 2/2000 | Burmeister et al. | 439/395 |

FOREIGN PATENT DOCUMENTS

| | | |
|---|---|---|
| DE | 28 02 674 | 8/1978 |
| DE | G 85 25 981.0 | 12/1985 |
| DE | 195 33 420 A1 | 3/1997 |
| DE | 197 32 182 C1 | 7/1997 |
| EP | 0 532 413 A1 | 3/1993 |
| EP | 0 936 697 A1 | 8/1999 |

* cited by examiner

*Primary Examiner*—Truc Nguyen
(74) *Attorney, Agent, or Firm*—Harness, Dickey & Pierce, P.L.C.

(57) ABSTRACT

An insulation displacement contact, for example for terminal strips, which has a slotted, sprung contact region as a contact-making slot on a connecting bracket, which contact region is surrounded and reinforced by an outer spring slip. The invention provides that the spring clip is designed to form an insulation displacement blade in at least one end region.

36 Claims, 1 Drawing Sheet

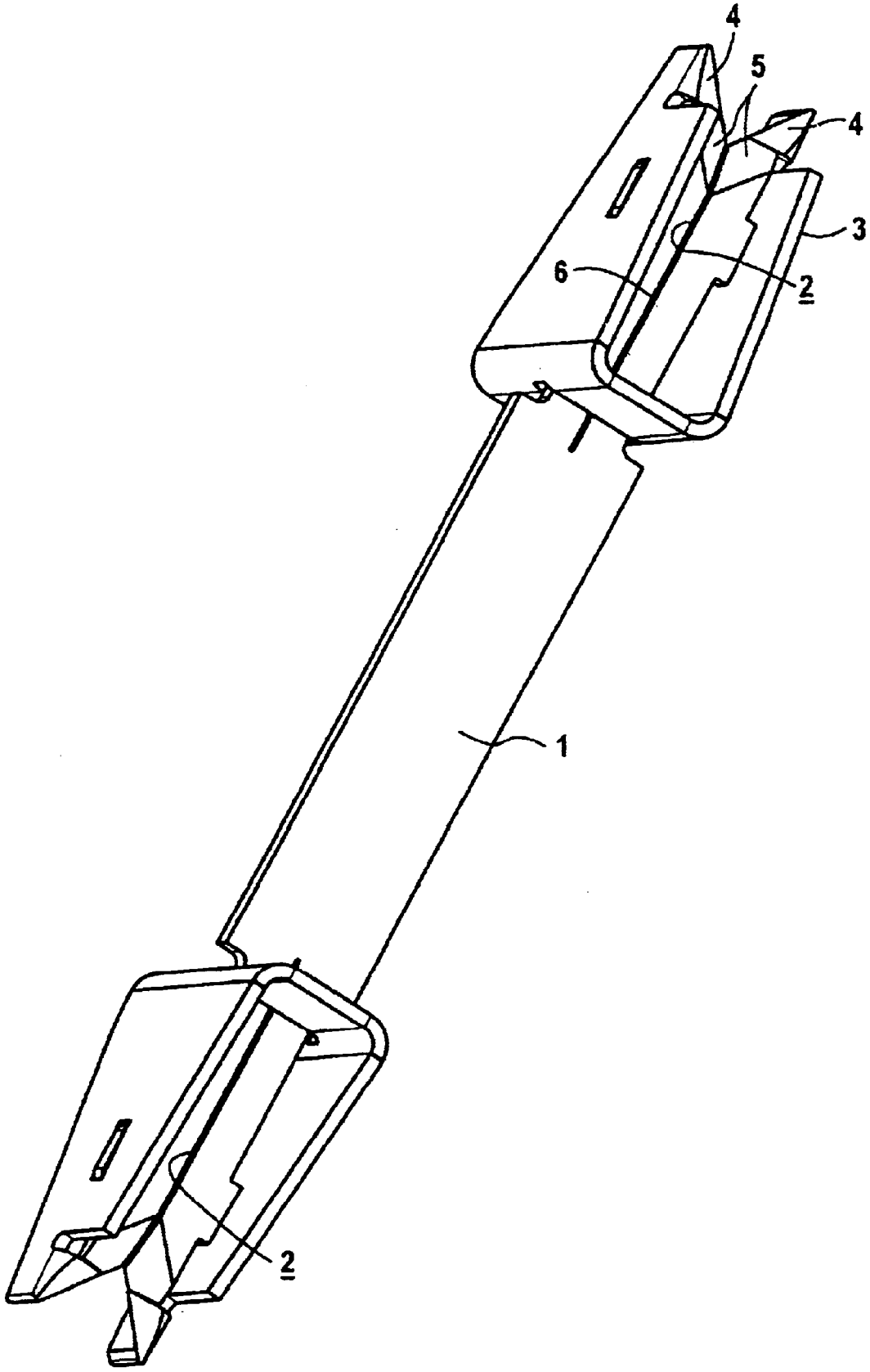
4
5
4
3
6
2
1
2

INSULATION DISPLACEMENT CONTACT AND CONNECTOR

This application is the national phase under 35 U.S.C. § 371 of PCT International Application No. PCT/DE00/01343 which has an International filing date of Apr. 28, 2000, which designated the United States of America, the entire contents of which are hereby incorporated by reference.

FIELD OF THE INVENTION

The invention generally relates to an insulation displacement contact. More preferably, it relates to an insulation displacement contact for terminal strips, including a slotted, sprung contact region as a contact-making slot on a connecting bracket, wherein the contact region is surrounded and reinforced by an outer spring slip.

BACKGROUND OF THE INVENTION

A known insulation displacement contact is disclosed in (DE-C1-197 32 182), for example. Further, DE 85 25 981 U1 discloses a two-part insulation displacement contact element, in which two separate contact elements having a contact-making slot are used. These surround both sides of a conductor with which contact is to be made, and pinch this conductor between them. When contact has been made, the first contact element surrounds the other, like a spring clip. The respective contact-making slots are widened like funnels in their entry region, forming an insulation displacement contact. In this embodiment, the insulation displacement contacts must be operated like tongs once the conductor has been inserted.

In the described, known insulation displacement contact, the material of the spring clip can be matched to the spring characteristics. Further, the contact region can be matched by shaping and the material coming to a compromise in order to achieve a cutting region and a contact region.

SUMMARY OF THE INVENTION

The invention is based an object of developing the described insulation displacement contact further, such that its cutting characteristics and contact characteristics can be even better matched.

The described object is achieved by an insulation displacement contact as claimed in claim 1, for example. In this case, the spring clip is designed to form an insulation displacement blade in at least one end region. This results in a cutting blade, or initial cutting blade in an initial cutting region, of mechanically particularly hard material. As such, even cold, brittle insulation on a conductor can easily be cut down to a conductive core. The shape of the contact region in the interior of the contact-making slot can also be matched to achieve particularly good contact characteristics. The contact-making slot can thus be formed with blunt contact zones in order to protect a contact core. This is due to the fact that the cutting blades which are formed from the spring clip, can be matched not only in terms of the initial cutting characteristics but also, if required, in terms of their secondary cutting characteristics.

The spring clip and cutting blades which are formed from the spring clip may be formed from suitably hard material. If required, the cutting blades may be specially hardened. The contact region may be formed from electrically highly conductive material.

The insulation displacement contact can advantageously be designed for use in a connecting terminal, in particular in a terminal strip, such that each connecting bracket forms a contact-making slot at each of its ends.

The spring clip and/or connecting bracket can advantageously be designed such that the limbs of the spring clip secure the contact-making slot in its position.

A connecting terminal having at least one insulation displacement contact can advantageously be provided according to one of the embodiments described above. In particular, a terminal strip having at least one insulation displacement contact can be provided in the embodiments described above.

BRIEF DESCRIPTION OF THE DRAWINGS

The invention will now be explained in more detail with reference to an exemplary embodiment which is illustrated, in perspective form, in the drawing.

DETAILED DESCRIPTION OF THE PREFERRED EMBODIMENTS

The drawing figure illustrates a slotted, sprung contact region formed as a contact-making slot 2 on a connecting bracket 1. This contact region is surrounded by an outer spring clip 3, reinforcing its spring effect.

The spring clip 3 is designed to form cutting blades 4 in at least one end region, in the exemplary embodiment shown in the drawing, in both end regions. The cutting blades 4 form a V-shaped entry region for initial cutting and for cutting open the insulation of a conductor to be inserted and to be connected. This can be followed by a secondary cutting region and also by the contact region itself.

In the exemplary embodiment shown in the drawing, a subsequent cutting region 5 is followed by a contact region 6, which is advantageously formed to be blunt and to be of electrically highly conductive material, thus protecting a conductor core. A secondary cutting region 5 may be in the form not only of the spring clip but also in the form of the connecting bracket 1, depending on the specific requirements.

The spring clip 3 and connecting bracket 1 in the exemplary embodiment have recesses and tongues such that the limbs of the spring clip 1 secure the contact-making slot 2 in its position. This prevents the limbs from being tilted and deflected into a number of planes, even when a number of conductors are inserted.

In the exemplary embodiment, the connecting bracket 1 forms a contact-making slot 2 at each of its ends.

A connecting terminal having at least one insulation displacement contact can advantageously be formed in one of the described embodiments. In particular, a terminal strip having screwless connections can be formed in this way.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An insulation displacement contact, comprising:

a slotted, sprung contact region as a contact-making slot formed about a longitudinal central axis of a connecting bracket; and an outer spring clip surrounding and reinforcing the contact region, wherein the spring clip forms an insulation displacement blade in at least one end region, the blade in the at least one end region forming a cutting region and located proximate to the contact region;

wherein the cutting region is substantially centered about the slot.

2. The insulation displacement contact as claimed in claim 1, wherein the contact-making slot includes at least one blunt contact zone to protect a conductor core.

3. The insulation displacement contact as claimed in claim 2, wherein the spring clip and blade are formed from suitably hard material, and wherein the contact region is formed from electrically conductive material.

4. The insulation displacement contact as claimed in claim 1, wherein each connecting bracket forms a contact-making slot at each of its ends.

5. The insulation displacement contact as claimed in claim 1, wherein at least one of the spring clip and the connecting bracket are designed such that limbs of the spring clip secure the contact-making slot in its position.

6. The insulating displacement contact as claimed in claim 1, wherein the cutting blade on the end region forms an entry region capable of cutting, and located in front of the contact region.

7. A connecting terminal having at least one insulation displacement contact as claimed in claim 1.

8. A terminal strip having at least one insulation displacement contact as claimed in claim 1.

9. The insulation displacement contact as claimed in claim 2, wherein each connecting bracket forms a contact-making slot at each of its ends.

10. The insulation displacement contact as claimed in claim 3, wherein each connecting bracket forms a contact-making slot at each of its ends.

11. The insulation displacement contact as claimed in claim 2, wherein at least one of the spring clip and the connecting bracket are designed such that limbs of the spring clip secure the contact-making slot in its position.

12. The insulation displacement contact as claimed in claim 3, wherein at least one of the spring clip and the connecting bracket are designed such that limbs of the spring clip secure the contact-making slot in its position.

13. An insulating displacement contact as claimed in claim 2, wherein the cutting blade on the end region forms an entry region capable of cutting, and located in front of the contact region.

14. An insulating displacement contact as claimed in claim 3, wherein the cutting blade on the end region forms an entry region capable of cutting, and located in front of the contact region.

15. A connecting terminal having at least one insulation displacement contact as claimed in claim 2.

16. A connecting terminal having at least one insulation displacement contact as claimed in claim 3.

17. A connecting terminal having at least one insulation displacement contact as claimed in claim 4.

18. A connecting terminal having at least one insulation displacement contact as claimed in claim 5.

19. A connecting terminal having at least one insulation displacement contact as claimed in claim 6.

20. A terminal strip having at least one insulation displacement contact as claimed in claim 2.

21. A terminal strip having at least one insulation displacement contact as claimed in claim 3.

22. A terminal strip having at least one insulation displacement contact as claimed in claim 4.

23. A terminal strip having at least one insulation displacement contact as claimed in claim 5.

24. A terminal strip having at least one insulation displacement contact as claimed in claim 6.

25. An insulation displacement contact, comprising:

a bracket, including a contact region formed about a longitudinal central axis of the bracket; and at least one spring clip attached to the bracket, wherein the spring clip includes a cutting blade portion located proximate to and substantially centered about the contact region.

26. The insulation displacement contact as claimed in claim 25, wherein the cutting blade portion includes a v-shaped region, adapted to cut insulation of a conductor.

27. The insulation displacement contact as claimed in claim 25, wherein the at least one spring clip is located at an end of the bracket.

28. The insulation displacement contact as claimed in claim 25, wherein the bracket includes a contact slot at each end.

29. The insulation displacement contact as claimed in claim 28, wherein a spring clip is attached at each end of the bracket.

30. The insulation displacement contact as claimed in claim 29, wherein the cutting blade portion includes a v-shaped region, adapted to cut insulation of a conductor.

31. A connecting terminal including at least one insulation displacement contact as claimed in claim 25.

32. A connecting terminal including at least one insulation displacement contact as claimed in claim 26.

33. A connecting terminal including at least one insulation displacement contact as claimed in claim 29.

34. A terminal strip having at least one insulation displacement contact as claimed in claim 25.

35. A terminal strip having at least one insulation displacement contact as claimed in claim 26.

36. The insulation displacement contact as claimed in claim 1, wherein the insulation displacement blade includes a v-shaped region, adapted to cut insulation of a conductor.

* * * * *